US005571995A

United States Patent [19]

Pierce

[11] Patent Number: 5,571,995

[45] Date of Patent: Nov. 5, 1996

[54] LOCKING SAFETY COVER FOR ELECTRICAL OUTLETS

[76] Inventor: David B. Pierce, P.O. Box 246, Bells, Tex. 75414

[21] Appl. No.: 160,248

[22] Filed: Dec. 2, 1993

[51] Int. Cl.[6] ..... H01R 13/44

[52] U.S. Cl. ..... 174/67; 220/242; 439/136; 439/148

[58] Field of Search ..... 174/66, 67; 220/242; 439/135, 136, 142, 148

[56] References Cited

U.S. PATENT DOCUMENTS

| | | | |
|---|---|---|---|
| 2,089,665 | 8/1937 | Roberts et al. | 174/66 X |
| 2,559,151 | 7/1951 | Getzoff | 174/67 X |
| 4,287,693 | 9/1981 | Collette | 52/177 |
| 4,648,649 | 3/1987 | Beal | 296/156 |
| 4,844,104 | 7/1989 | Martin | 132/321 |
| 5,009,610 | 4/1991 | Woskow | 174/67 X |
| 5,080,599 | 1/1992 | Wimberly | 174/67 X |
| 5,096,430 | 3/1992 | D'Amico | 174/67 X |
| 5,106,314 | 4/1992 | Bael | 174/67 X |

*Primary Examiner*—Kristine L. Kincaid
*Assistant Examiner*—Paramita Ghosh
*Attorney, Agent, or Firm*—Jerry C. Ray

[57] ABSTRACT

A safety cover for electrical outlets includes a center locking block which is attached to an electrical outlet by a screw, and which has grooves to receive elongate members integral with individual receptacle covers. Matching cross-sectional shapes of the grooves and members fit closely so that the elongate members are retained in the grooves. A flexible latching arm on the front of a receptacle cover engages the locking block to latch the cover in place; the latching arm is pressed aside with a fingertip to permit removal of the receptacle cover. One of the covers has prongs which engage openings in the receptacle to prevent the safety cover assembly from being rotated around the mounting screw.

4 Claims, 2 Drawing Sheets

LOCKING SAFETY COVER FOR ELECTRICAL OUTLETS

CROSS REFERENCE TO RELATED APPLICATIONS

None.

BACKGROUND OF THE INVENTION

1. Field of the Invention

This invention relates to safety covers for receptacles on electrical outlets, and more particularly to such covers having a locking block to which individual receptacle covers are attached to prevent their removal.

2. Description of the Related Art

Several U.S. patents, listed below, disclose safety covers for electrical outlets. All the patents address the general problem of preventing accidental electric shock, especially to small children. The difficulty lies in leaving the outlet reasonably accessible for use, while at the same time covering it sufficiently to prevent accidental contact and electrocution.

Children, especially toddlers, sometimes are accidentally electrocuted by inserting a metallic object such as a paper clip, hair pin, or a nail file into an unprotected receptacle. Another type of accidental shock occurs when a child is playing with a plugged-in cord. In trying to remove the cord from the receptacle, a child often will grasp the plug so that his fingers touch the prongs while they are still plugged in. The present invention provides a solution to both aspects of the problem, by preventing insertion of foreign objects into a receptacle, and also by preventing removal of a plug.

Several of the patents listed below disclose a safety cover which is attached to the outlet assembly by a screw provided to hold the outlet cover in place. Cormier, Lerner, Piper, and Buckshaw further disclose flexible means for attaching the outlet cover to some part of the cover assembly. None of the patents or other publications known to Applicant disclose individual receptacle covers which mate with and are held in place by a separate locking block.

Before this application was filed, a search was made in the U.S. Patent and Trademark Office. That search developed the following U.S. patents:

| U. S. Pat. No. | Issue Date | Patentee |
|---|---|---|
| 2,559,151 | July 3, 1951 | Getzoff |
| 2,878,456 | Mar. 17, 1959 | Cormier |
| 2,932,811 | Apr. 12, 1960 | Abraham, et al. |
| 4,671,587 | Jun. 9, 1987 | Lerner, et al. |
| 4,801,271 | Jan. 31, 1989 | Piper |
| 4,981,439 | Jan. 1, 1991 | Piedmont |
| 5,009,610 | Apr. 23, 1991 | Woskow |
| 5,017,148 | May 21, 1991 | Buckshaw |
| 5,080,599 | Jan. 14, 1992 | Wimberly |
| 5,106,314 | Apr. 21, 1992 | Bael |

SUMMARY OF THE INVENTION

3. Progressive Contribution to the Art

This invention has a locking block which is secured to an electrical outlet, preferably by a screw, with individual receptacle covers retained in place by the locking block. The locking block is a rectangular solid, with a front surface, top, bottom, and sides substantially orthogonal.

As used herein, "receptacle" means a permanently mounted female electrical fitting containing live parts of the circuit. An "electrical outlet," sometimes referred to as an "outlet," comprises one or more receptacles.

The receptacle covers are made from electrically nonconducting material; many plastics are suitable, such as nylon, polyethylene, and polypropylene. Each receptacle cover has an integral elongate member which slides into a groove in the locking block. In cross section, the elongate member has a size and shape to closely fit into the groove in the locking block. The groove and the matching elongate member have the same cross-sectional shape such as a triangle or an oval so that when the elongate member is inserted in the groove, it can be removed only by sliding from the groove. The open top of the groove forms a slot-shaped opening in the surface of the locking block. This slot, i.e., the top of the groove, receives the relatively narrow part of the elongate member where it is joined to the receptacle cover. The receptacle covers are also equipped with a groove on one side, for storing another receptacle cover while one of the receptacles is in use.

One of the receptacle covers has prongs integral with the cover which are configured like the prongs on a electrical cord plug. When the cover is in place, the prongs engage the openings in the receptacle, and prevent the cover from being rotated around the mounting screw.

Alternatively, one or both the individual receptacle covers are locked into place by retractable prongs which fit into a pair of apertures in the cover. Joined together by a cross-piece outside the surface of the cover, the two prongs and the cross-piece form a U-shaped locking device. The prongs are retracted as the cover is slid into place in the groove, and when the cover is in place the prongs are pushed in so that they engage the openings in the receptacle. The retractable prongs and the integral prongs prevent the receptacle covers from being easily removed, and as mentioned above, prevent the entire assembly from being rotated around the mounting screw.

In one embodiment, the second cover has no prongs, instead being latched into place by a flexible latching arm. The latching arm extends from the front of a receptacle cover, and is positioned and shaped so that the arm is pushed aside by the locking block as it is slid into the groove. When the receptacle cover is fully engaged in the groove, the locking tab flexes back into its normal position and latches the cover into the groove.

In the top and bottom of the locking block an aperture is provided, to provide an anchor point for a cord tie. Because the grooves in the top and bottom of the block do not extend the full width of the block, a portion of the top and bottom are left solid. The apertures penetrate these solid parts of the block. A cord tie is inserted through the aperture, and then secured to a plugged-in cord to prevent its accidental removal.

4. Objects of this Invention

A primary object of this invention is to prevent injury and death to children caused by accidental electrical shocks.

Another object of this invention is to provide a secure, safe apparatus to cover an electrical outlet while leaving the outlet accessible for use.

Another object of this invention is to provide a safety cover for individual electrical receptacles which incorporates a method for securing plugs in the receptacles of an outlet to prevent their accidental removal.

Further objects are to achieve the above with devices that are sturdy, compact, durable, lightweight, simple, safe, efficient, and reliable, yet inexpensive and easy to manufacture, install, operate, and maintain.

The specific nature of the invention, as well as other objects, uses, and advantages thereof, will clearly appear from the following description and from the accompanying drawings, the different views of which are not necessarily scale drawings.

To assist in correlating the terms of the claims to the exemplary drawings, the following catalog of elements is provided:

10 Locking Block
12 Aperture for Locking Block Screw
14 Locking Block Screw
16 Locking Block Groove
18 Aperture for Cord Tie
20 Receptacle Cover
22 Elongate Member
24 Cover Prong
26 Latch Arm
30 Shoulder
40 Receptacle
42 Outlet Cover Plate
44 Electrical Outlet

DESCRIPTION OF THE PREFERRED EMBODIMENTS

Figure 1:
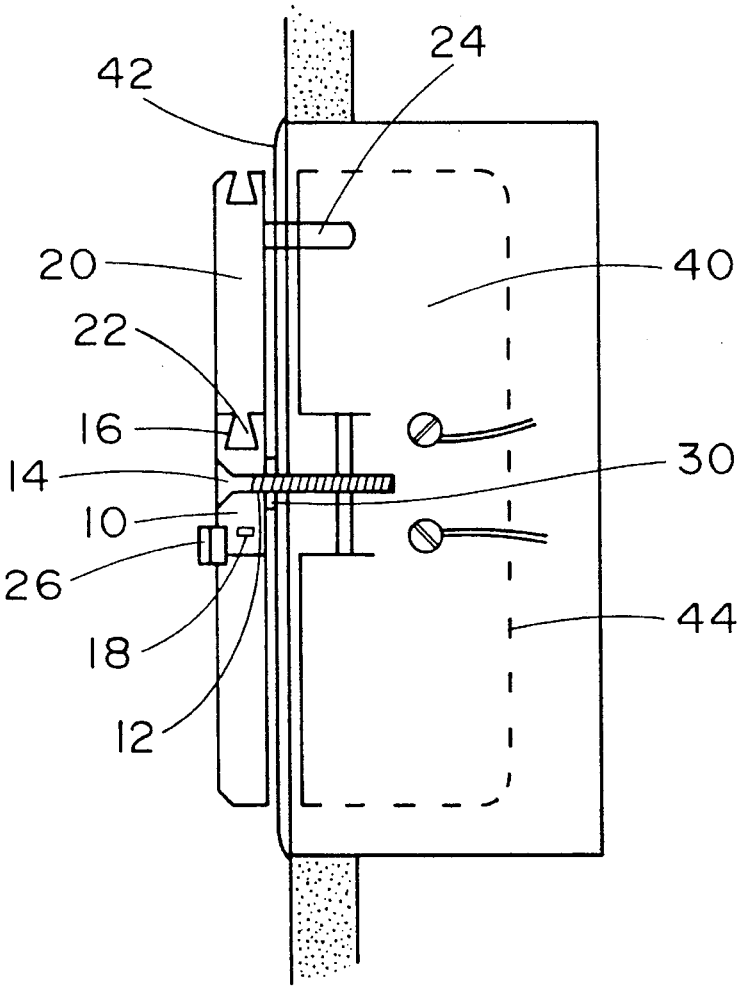
FIG. 1 is a cross section of the safety cover in place on an electrical outlet.

Referring to the drawings, FIG. 1 shows locking block 10 with aperture 12. A screw 14 inserted through the aperture 12 replaces the screw that normally holds the cover plate 42 on the outlet 44. The screw 14 is long enough to pass through both locking block 10 and cover plate and hold both securely against the outlet 44. When mounted in place on a duplex outlet, the locking block 10 is positioned between the two individual receptacles. A shoulder 30 on the locking block 10 surrounds the aperture 12. The shoulder 30 bears against the outlet cover plate 42, and provides clearance between the locking safety cover and the outlet cover plate 42 in the event that the surface of the receptacles 40 extend beyond the surface of the outlet cover plate.

Figure 2:
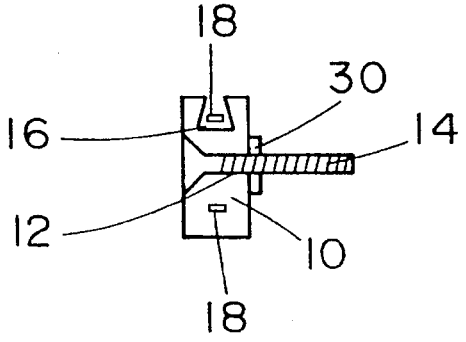
FIG. 2 is a detail showing a cross section of the locking block.

Again referring to FIG. 1, and also to FIG. 2, the locking block 10 has a groove 16 each beginning on an opposite side of the block, and extending along a portion of the length of the locking block. One groove is on the top of the block; another groove is on the bottom of the block. An end of the groove 16 forms an opening at the side of the locking block 10. The opening is a cross section of the groove 16. The open top of the groove 16 intersects a surface of the block 10 to form a slot-shaped opening along a surface of the block. The groove forms part of the mechanism by which the individual receptacle covers 20 are locked to the locking block 10 and thus held in place. As used herein, a receptacle cover is defined as a cover made from plastic or some other electrically nonconducting material, and which is sized and shaped to fit over and cover a single electrical receptacle.

A cross section of the groove 16 reveals a portion of the groove nearest the center of the locking block having a particular shape and size, as described below. This section of the groove 16 receives an elongate member 22 which is integral with the receptacle cover 20, as described below. In cross-section, the shape of the groove may be that of a truncated isosceles triangle, a circle, an oval, a hexagon, or some other shape. An opening where the top of the groove 16 meets a surface of the locking block 10 is slot-shaped. The slot-shaped opening is relatively narrower than the cross-section of the groove.

Figure 3:
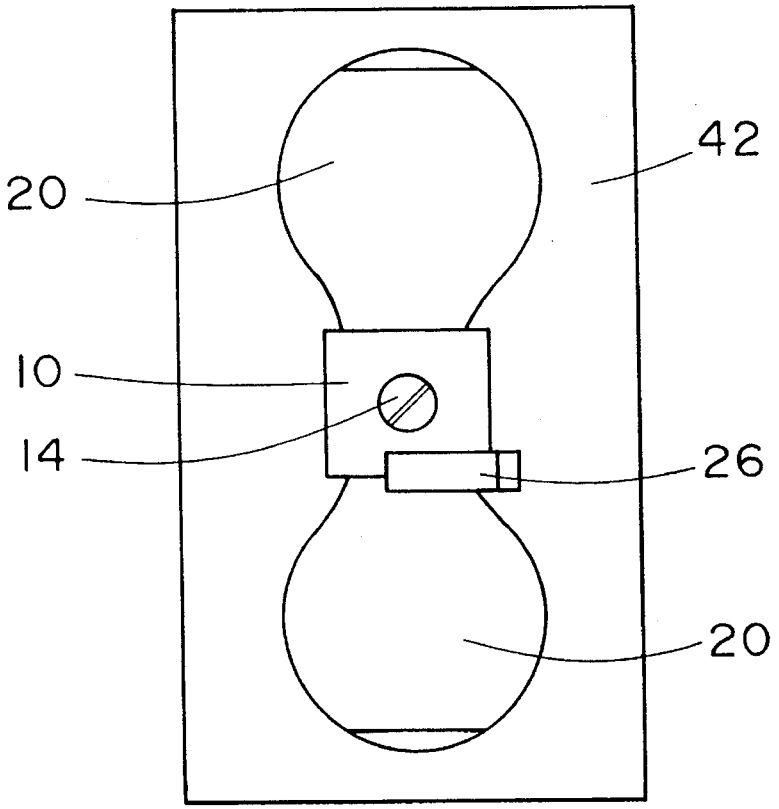
FIG. 3 is an elevation of the safety cover in place on an electrical outlet.

Referring to FIG. 3, individual receptacle covers 20 are shaped to cover the receptacles in the electrical outlet 44. The covers 20 are made of plastic or some other suitable dielectric material. At least one of the covers will have prongs 24 extending from a flat surface of the cover 20, in the same configuration as the prongs on an electrical cord. The prongs 24 engage the openings of a receptacle in the same manner as the prongs of a plug on a cord. Where the safety cover is being used with only one individual receptacle cover in place, a cover with integral prongs is used. The prongs, inserted into the openings of a receptacle, prevent the entire assembly being rotated around the screw, which would allow a receptacle to be exposed.

Joined to one side of each individual receptacle cover 20 is an elongate member 22. The elongate member is integral with the cover. In cross-section, the elongate member 22 is relatively narrower where it merges with the receptacle cover 20. The elongate member 22 has a cross-section which is sized and shaped to slide into the groove 16 on the locking block 10. A cross-sectional diameter of the elongate member 22 is of course slightly smaller than a cross-sectional diameter of the groove 16 with which it mates. The relatively narrower part of the elongate member has a width to fit into the slot-shaped opening formed by the top opening of the groove. Because the cross-section dimension of the elongate member is larger than the dimension across the narrow portion of the slotted top of the groove, the elongate member is held in place in the groove.

Figure 4:
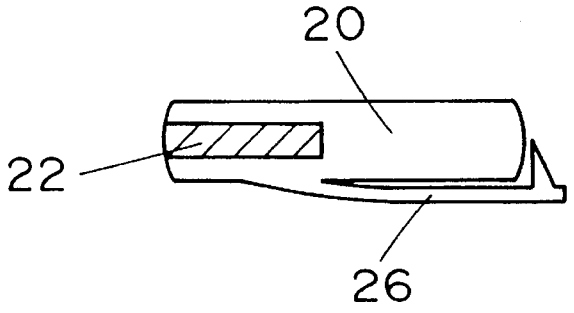
FIG. 4 is an detail showing a plan view of an individual receptacle cover.

A resilient latch arm 26 is made integral with a receptacle cover 20. Illustrated in FIG. 4, the latch arm extends along and adjacent a front surface of the receptacle cover, and at one end has a latching surface at substantially right angles to the latch arm. The latch arm is positioned so that the locking block 10 bears against the end of the arm and causes the arm to flex away from the locking block as the elongate member is pushed into the groove. As the elongate member reaches the full depth of the groove, the resilient latch arm flexes back into its latching position. In its latching position, a latching surface on the latch arm removably engages the locking block and prevents the cover 20 from sliding out of the groove 16. To remove a cover which is latched in place, a fingertip is used to flex the latching arm outward, out of engagement with the locking block, so that the cover can be slid from engagement pulled outward, away from the receptacle, and with the groove and removed from the receptacle.

An alternate embodiment utilizes a retractable latch mechanism. One or more prongs fit into and move within apertures in the receptacle cover. The apertures and retractable prongs have the same configuration and spacing as the prongs on a standard electrical plug. Outside the outer surface of the cover, a graspable crosspiece joins the prongs together so that prongs and crosspiece have a U-shape. Together, the crosspiece and prongs form the retractable latch. The crosspiece includes a surface for grasping the latch and pulling the prongs outward from the receptacle into a retracted position. Where only one prong is used, the graspable crosspiece and the prong are in a T-shape, with the cross of the T forming a surface for grasping the latch. When the prongs are retracted, the receptacle cover can be moved into and out of the groove (described below). When the cover is in place in the groove, the prongs are pushed in to engage openings in the receptacle, thereby latching the cover in place. In one embodiment of the invention, one cover has integral prongs and one cover has retractable prongs for easy removal.

Each groove extends along only part of the length of the locking block; a portion of the block is left solid, or ungrooved. This ungrooved portion of the locking block is perforated with an aperture 18 for receiving a cord tie. The top and bottom of the locking block each has a groove along part of its length and an aperture through the remaining part of its length. Where an electrical cord is inserted into one of the receptacles, the groove for that side is empty, leaving the aperture accessible. The cord tie is inserted through the aperture and then attached to the cord to secure the cord in the receptacle. Ties suitable for use as cord ties include the simple plastic locking ties of the type known as ty-wraps or cable ties. Other types of ties may also be used, such as ties specially made to fit around an electrical cord.

The embodiments shown and described above are only exemplary. I do not claim to have invented all the parts, elements, or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A safety cover for electrical outlets, comprising:

a) a locking block secured to an electrical outlet, d) said locking block having a front, two sides, a top and a bottom, b) said locking block having at least one groove therein, c) at least one receptacle cover having an integral elongate member to slidably engage said at least one groove in said locking block, e) said at least one groove beginning at one side and extending therefrom along a portion of the top, and another of said at least one groove beginning at another side and extending along a portion of the bottom, f) each of said grooves having a cross section sized and shaped to receive said elongate member integral with said receptacle cover, g) said elongate member having a cross section sized and shaped to slidably engage one of said grooves, h) said receptacle cover having therein a groove in which to place another receptacle cover for storage, and i) said receptacle cover having two or more retractable prongs to engage an electrical outlet.

2. The invention as described in claim 1, further comprising:

means for latching said receptacle cover in position over the receptacle, said means for latching including a flexible latching arm, said latching arm being integral with said receptacle cover, and said latching arm being positioned to removably engage a side of said locking block when said elongate member is fully disposed within one of said at least one groove.

3. The invention as described in claim 1, further comprising:

said retractable prongs slidably disposed in apertures in said receptacle cover, each of said prongs noting a graspable crosspiece on an outer end of said each of said prongs and said prongs joined together by said graspable crosspiece.

4. A method of preventing accidental contact with an electrical outlet, comprising:

a) securing a grooved locking block to an electrical outlet, b) engaging at least one receptacle cover in a groove in said locking block, and c) latching said receptacle cover in place with a flexible latching arm which removably engages a surface of said locking block.

* * * * *